US007185698B1

(12) United States Patent
Bernert, Jr. et al.

(10) Patent No.: US 7,185,698 B1
(45) Date of Patent: Mar. 6, 2007

(54) THERMAL SHIELD FOR HEAT EXCHANGERS

(76) Inventors: Robert E. Bernert, Jr., 695 Dartmouth St., Dartmouth, MA (US) 02748; Robert E. Bernert, Sr., 695 Dartmouth St., Dartmouth, MA (US) 02748

( * ) Notice: Subject to any disclaimer, the term of this patent is extended or adjusted under 35 U.S.C. 154(b) by 0 days.

(21) Appl. No.: 11/040,581

(22) Filed: Jan. 21, 2005

Related U.S. Application Data

(60) Provisional application No. 60/538,154, filed on Jan. 22, 2004.

(51) Int. Cl.
*F28F 13/00* (2006.01)

(52) U.S. Cl. ..... 165/135; 165/158; 165/176

(58) Field of Classification Search ..... 165/135, 165/157, 158, 176; 62/50.2
See application file for complete search history.

(56) References Cited

U.S. PATENT DOCUMENTS 3,568,764 A * 3/1971 Newman et al. ..... 165/134.1
4,034,803 A * 7/1977 Reed et al. ..... 165/103
4,706,743 A * 11/1987 Chalimbaud ..... 165/134.1
5,350,011 A * 9/1994 Sylvester ..... 165/135
6,334,483 B1 * 1/2002 Berglund et al. ..... 165/134.1
6,904,959 B2 * 6/2005 Pigatto ..... 165/82

FOREIGN PATENT DOCUMENTS

JP 60-256797 * 12/1985

* cited by examiner

*Primary Examiner*—Teresa J. Walberg
(74) *Attorney, Agent, or Firm*—Robert J Doherty

(57) ABSTRACT

An improved heat exchanger that reduces the thermal stress in components thereof especially tube plates or tube sheets so as to enable greater temperature differences across adjacent components while reducing the temperature gradient and thus extending the life of the heat exchanger is accomplished by attaching or bonding an insulating material of low thermal conductivity such as a sheet of PTFE, a metal jacketed layer of insulating cork or nonmetallic composite such as micarta sheeting to the metal component or tube sheet or tube plate.

11 Claims, 4 Drawing Sheets

THERMAL SHIELD FOR HEAT EXCHANGERS

Figure 1:
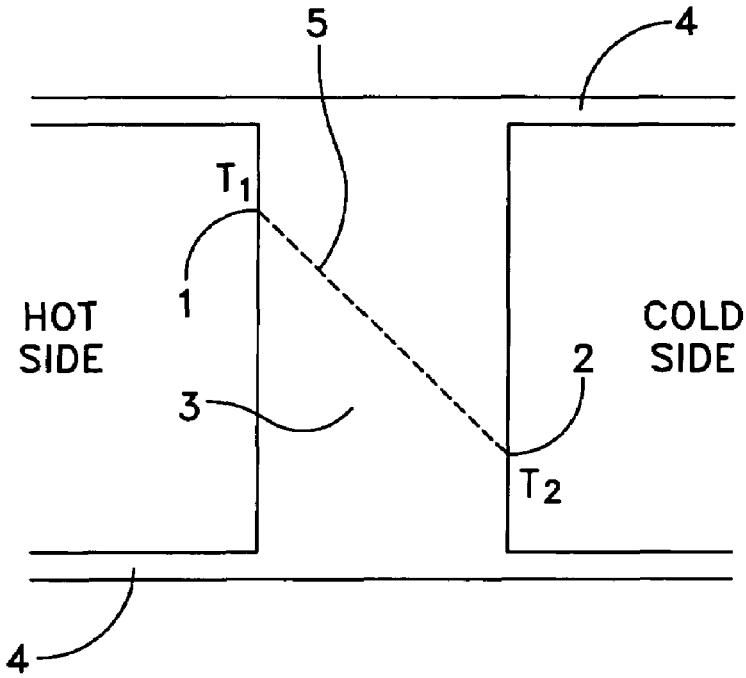

This application claims the benefit of our Provisional Application Ser. No. 60/538,154 filed Jan. 22, 2004.

BACKGROUND

The present invention relates generally to a method for reducing the thermal stress in heat exchanger components and/or tube plates. More particularly the invention provides a method for increasing the thermal difference between the fluids in heat exchanger sections or compartments without increasing the thermal stresses in the heat exchanger metal components. Thermal stress causes premature or unplanned fatigue failure, the most common service failure in heat exchangers. Heat exchanger design for high temperatures has considered thermal stress for many years set out in our above referred to Provisional Application. Further the ASME Pressure Vessel Code requires consideration of temperature gradients during vessel design. Thermal stress is not the same as very high or very low temperature protective means, such as insulation shrouds or radiation shields. When fluids of different temperatures are separated by a metal component within the heat exchanger, a temperature gradient is established within or across the metal component. In the particular case of cryogenic fluid heat exchangers high thermal gradients regularly occur. Since metals generally expand or contract in a fixed proportion as its temperature is increased or decreased, the level of temperature difference between one side of the metal and the other established by the different fluid temperatures results in one side of the metal plate or sheet expanding or contracting an amount different from the other side which results in thermal stress in the metal component. Since most heat exchangers contain fluids under pressure, which result in mechanical stress within the metal plate, the thermal stress may add or subtract from the total stress within the metal plate during start-up or during operation. Stress in metal plates result in plate deformation and too high a stress may lead to rupture, creep or failure by cyclical fatigue. Reduced plate deformation in and of itself is also desirable (ref. U.S. Pat. No. 5,518,066 for example) and is a cause for detrimental leakage at flanged joints.

Many types of mechanical design techniques have been employed to reduce detrimental thermal stress in heat exchangers such as described in Reference [3]. In some instances, ceramic coatings have been applied directly to the metal in a thin layer for corrosion and total thermal protection. In other instances, intermediate fluids are used to reduce individual temperature differences. The recommended level of temperature difference across metal components is between 100° F. and 200° F. The design allowable difference being generally determined by consideration of the type metal, the type fluid, the fluid velocity and component part being considered. For example, austenitic stainless steel has thermal shock susceptibility 3 to 6 times higher than carbon steel, and therefore temperature gradients are an important consideration for evaluation of fatigue life of austenitic S.S.

The teachings of the instant invention are particularly applicable to the vaporization of cryogenic fluids at temperatures to below −300° F. using steam or water, which may be at +50° F. to 400° F. The total temperature difference between the fluids is 350 to 700° F., hence the temperature difference in a metal component separating the two fluids is 350 to 700° F. Since this is well above the recommended difference of 100 to 200° F. in the cited references, high thermal stress can be expected, especially in the tube plate or sheet. Additionally, since the cryogenic fluid enters the tubes of the tube plate at high velocity, high thermal stresses are set up within the metal ligaments between adjacent tube holes within the tube plate because the high velocity at these locations creates functional heat, which in turn reduces the normal temperature difference in the fluid boundary layer. Further, austenitic stainless steel is a preferred metal of construction for cryogenic heat exchangers. The higher thermal stress potential of austenitic stainless steel affects the higher thermal shock susceptibility of the austenitic stainless steel. It is understandable, therefore that failures in these cryogenic heat exchangers is common in areas of high temperature difference in combination with high mechanical stress, especially in tube sheets and at the intersections of components attached to the tube sheets.

In any location within the heat exchanger, it is desirable and many times essential to reduce the temperature differences across the metal component.

OBJECTS

Accordingly, it is an object of this invention to provide a method to reduce thermal stress within heat exchangers.

It is another object of the invention to reduce the temperature difference across heat exchanger components.

It is another object of this invention to provide an improved method of design for heat exchangers, which have higher than recommended temperature difference between fluids within the heat exchanger.

It is another object of the invention to provide an improved cryogenic heat exchanger which handle fluids to below −300° F. which are to be heated with fluids such as air, water or steam between −50° F. to +500° F.

It is another object of the invention to provide a cryogenic vaporizer substantially avoiding the problem of thermal stress and cyclical fatigue common in these prior art heat exchangers.

It is a further object of the invention to provide a reduced thermal stress cryogenic vaporizer of the 2-pass u-bend tube type by substantially reducing the thermal stress within the tube sheet.

It is a further object of the invention to provide a reduced thermal stress cryogenic vaporizer of the 2-pass u-bend type by substantially reducing the thermal stress across the splitter plate.

It is a further object of the invention to provide a reduced thermal stress tube sheet and tube ligaments within the heat exchanger by separating the vaporizer liquid from the tube hole within the tube plate with individual tube entry inserts.

It is a further object to reduce the combined welding, mechanical and thermal stress in the tube plate to channel connection points.

It is a further object to provide a reduced thermal stress tube sheet and tube to tube sheet weld by means of a thermal barrier sleeve on each tube as it leaves the tube plate to reduce heat flow and the temperature gradient in each tube where it enters the tube plate.

SUMMARY OF THE INVENTION

These and other objects of the invention are achieved by providing means to reduce the temperature gradient in metal components of heat exchangers via a thermal barrier or barriers between the metal component and the fluid contained therein and further in the case of high velocity fluids entering the tube ends which pass through a metal tube sheet, via flow balancing fluid injectors in the tubes such that the injector also separates the higher velocity fluid flow from the tube plate and tube plate hole via a thermal shield sleeve extending into the tube inlet portion. The thermal barrier reduces the heat transfer process to the metal component or tube plate, thereby reducing the temperature gradient and resulting thermal stresses within the metal components. In a particular embodiment, a thermal barrier is placed at each tube entry point and extends into the tube entry effectively reducing thermal stress both at the tube entry and within the tube hole of the tube plate.

Additionally, where the heat exchanger component such as the tube plate part of a cryogenic vaporizer, which vaporizes pressurized cryogenic fluids and where the tube plate has fixed edges, the thermal stress is additional to the mechanical pressure stress. The reduced thermal stress effectively extends the useful life of the heat exchanger.

Additionally, where the fixed end of the tube plate is extended to form a flange to contain the heating medium within the shell portion of the heat exchanger, the reduction in thermal stress component of the combined welding, mechanical and thermal stress reduces related thermal distortion, thereby preventing leakage in the flange gasketed surfaces.

THE DRAWINGS

FIG. 1 Shows a typical temperature gradient [5] in a heat exchanger component [3] without a thermal shield. The temperature gradient and its proportional thermal stress in the metal component are proportional to the total temperature difference between the hot and cold fluids $T_1$ [1] and $T_2$ [2]. Fluid container [4] contains the fluids, which may be pressurized, within the heat exchanger.

Figure 2:
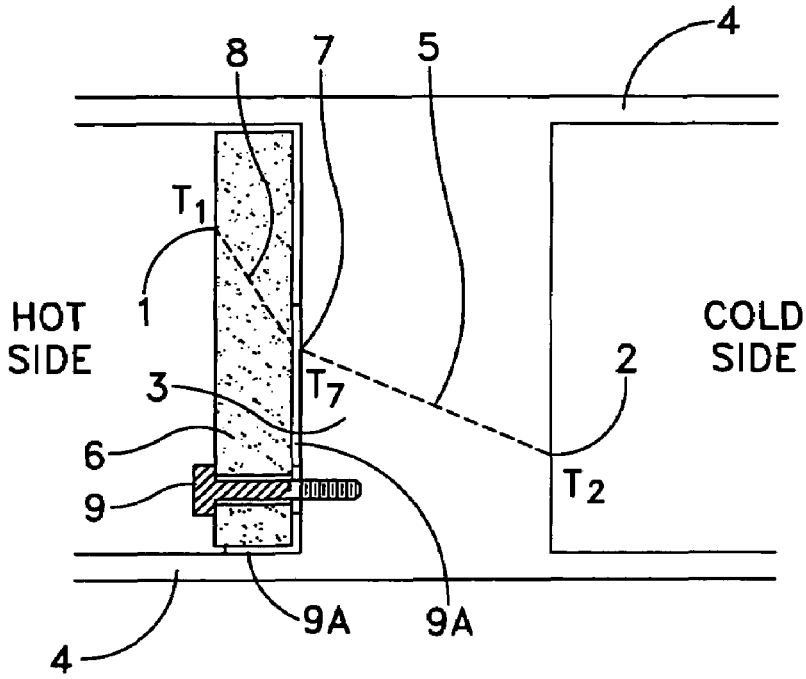

FIG. 2 Shows the addition of the thermal shield [6] to one of the component surfaces. Since the heat must pass through the shield, which is preferably of low thermal conductivity material, the temperature at the metal surface to which the shield is attached is reduced, thereby reducing the temperature gradient and resulting thermal stress within the metal component [3]. The shield [6] may be attached to exchanger component [3] via fastener [9] e.g a bolt threaded into the component. Alternatively, or in conjunction with fastener [9], the shield [6] may be bonded to the metal component [3] using a suitable PTFE to metal adhesive [9A].

Figure 3:
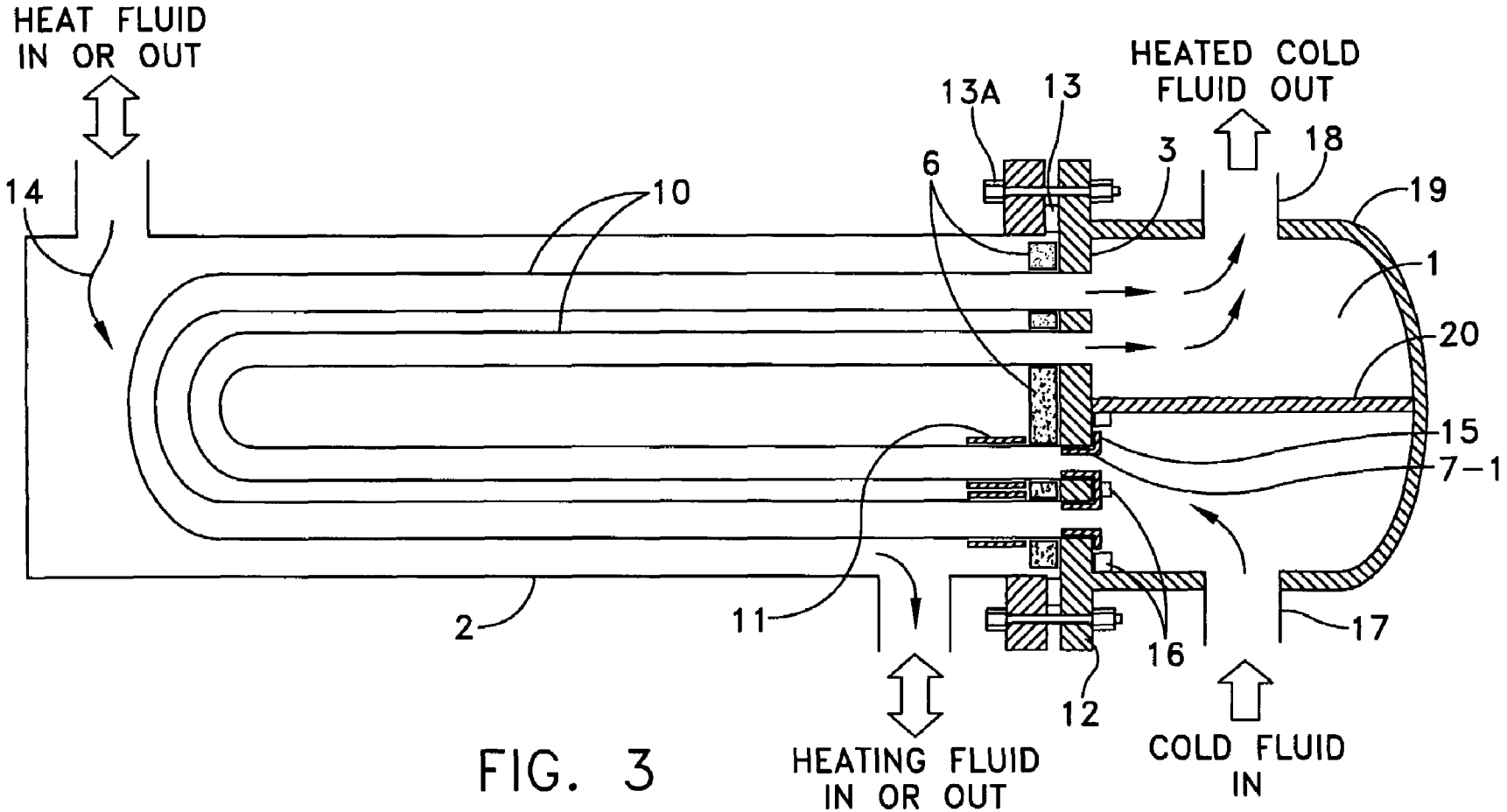

FIG. 3 Shows a perspective partial cutaway view of a cryogenic U-bend heat exchanger according to a preferred embodiment of the present invention showing the addition of thermal shields. Now referring to FIG. 3, tube bundle assembly [1] is inserted into heating chamber [2] and secured via bolting means [13A] and sealed to prevent leakage with gasket means [13]. In operation, cold fluid to be heated and vaporized enters bundle assembly [1] at nozzle [17] subsequently passing into tubes [10] which are immersed in heating medium [14], such as steam or hot water, and finally exiting the bundle assembly at exit nozzle [18]. Providing containment of the cold fluid within bundle assembly [1] is the bonnet [19]. Splitter plate [20] effectively directs cold fluid flow into the inlet of tubes [10]. Said splitter plate is secured into tube plate [3] and also directs the heated and vaporized cold fluid to the exit nozzle [18] after the fluid leaves tube [10] exit point, said exit point being fastened in a leak tight manner into tube plate [3].

According to this preferred embodiment, there is the addition of thermal shield [6] to the tube plate [3]. The tubes [10] pass through the thermal shield [6], which may be extended with a sleeve [11] on each tube or made thicker to meet the desired level of protection of the tube plate. The tube plate in the particular embodiment shown is of the extended form [3] and [12] to provide a gasket means [13] to contain the heating fluid after the U-bend bundle is inserted into the heating fluid container [2]. Reduced distortion of the tube plate from thermal stress by use of the thermal shield reduces leakage at the gasket [13], a most common source of failure in U-bend exchangers. Tube hole thermal shields [15] extend into each tube hole via shield extensions [7-1] and cover the inlet face of the tube plate [3] via an extended flange or lip. Tube plate entry face has a reduced cooling thermal gradient via the entry thermal shield [16], which covers or partially covers the inlet face of the tube plate.

Figure 4:
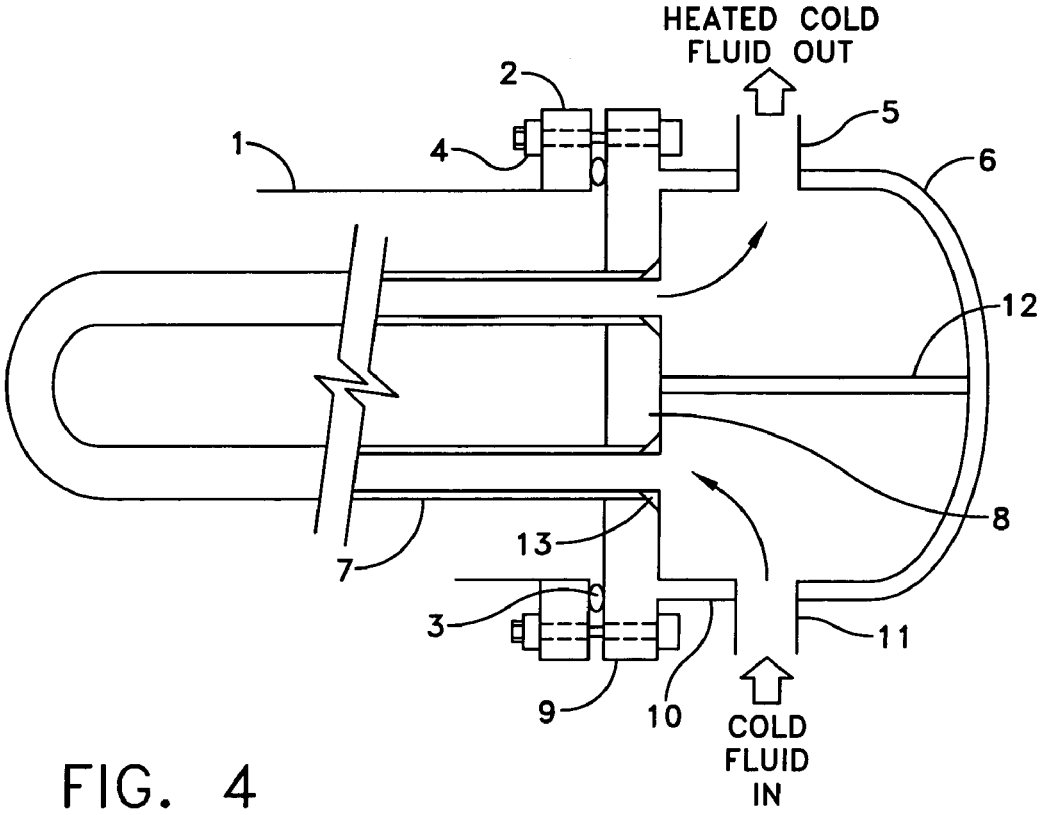

FIG. 4 Shows a partial perspective cutaway view of prior art/cryogenic U-tube vaporizer assembly which has no means of reducing thermal stress. The assembly illustrates a tube bundle assembly comprised of bonnet [6] and channel [10] containing inlet nozzle [11], exit nozzle [5] with splitter plate [12] attached by suitable means such as welding directly to tube plate [8]. The U-bend tubes [7] are inserted through the tube plate [10] and fixed into the tube plate at both ends via welded joints [13]. Said weld joints being directly in contact with the cold fluid as it enters the tube, are exposed to the maximum temperature difference between the heating medium contained in the shell [1] and in the case of steam and liquid nitrogen, such temperature difference is in excess of 500° F. causing thermal stress in plate [9] and at tube securing weld [13]. Thermal distortion of the tube plate is also cause for leakage at gasket means [3] which seals the bundle assembly into shell assembly at bolted joint [4] and [2] against tube plate extension [9].

Figure 5:
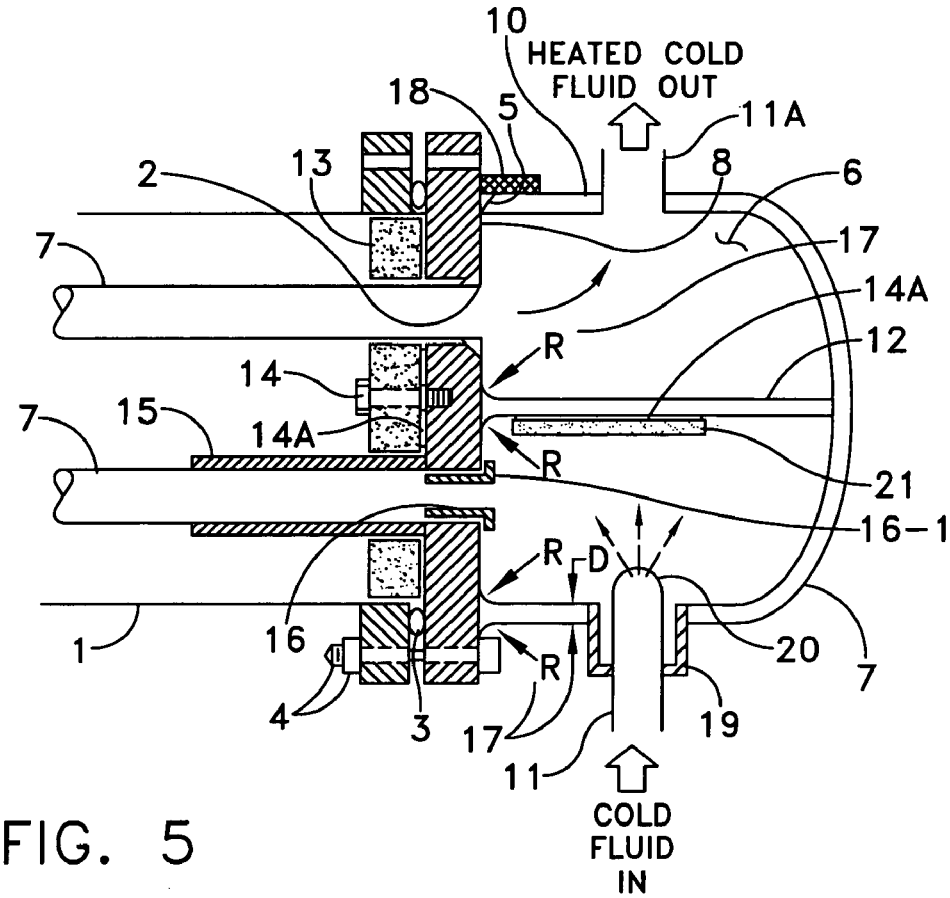

FIG. 5 Shows a perspective partial cutaway view of a U-bend cryogenic heat exchanger such as described in FIG. 4, but with reduced thermal and mechanical stress features according to a preferred embodiment of the present invention employing thermal shields added at critical locations. Now referring to FIG. 5, tube bundle assembly [6] is comprised essentially of bonnet [7] and channel [10] with inlet [11] and outlet [11A] nozzles separated via splitter plate [12]. Said bonnet is affixed by welding [5] to tube plate [8]. Said bundle assembly is inserted into heating medium container [1], secured via bolting [4] and sealed by means of gasket [3]. The tube plate [8] is drilled to accept U-tubes [7] the ends of which are inserted through said tube plate drilled hole and secured and sealed by welding means [2].

Thermax shield [13] preferably of low thermal conductivity material such as Teflon or PTFE is affixed by means of bolting [14] and/or by suitable cryogenic adhesive bonding [14A] directly to the heated side of tube plate [8] effectively preventing heating fluid means from direct contact with said tube plate. Further reducing heat input into tube plate [8] tube holes is by means of tube and thermal shield [15] which may pass through shield [13]. As in FIG. 3, heating fluid entry/exit means (not shown) are provided. On the channel [10] side of tube plate [8], the highest mechanical stress in the tube plate at welding means [5] is attached the doubler metal component [18] by welding means which effectively reduces mechanical stress at this attachment point. Alternatively, welding means [5] may have weld shape control by proportioning means radius [R] such that suitable ratio R/D [17] is formed with consideration of channel thickness [D]. Typically an R/D ratio of unity or one is close to ideal thereby reducing the stress concentration over 50% when compared with non-proportioned welding means [5].

Now considering cold fluid inlet nozzles [11], nozzle sleeve extension [19] permits channel [10] stress reduction and inlet nozzle spraying means [20] distributes cold fluid reducing potential of direct fluid impingement on to splitter plate [12]. Direct cold fluid impingement onto splitter plate [12] is prevented by thermal shield [21] of Teflon or other suitable material directly fastened or bonded [14A] to plate [12].

Thermal stress reduction at the tube entry point in the tube plate at securing means [5] is obtained by using thermal shield [16] with extended face lip [16-1]. Shield [16] forms a thermal barrier within the tube plate hole itself, said shield being affixed by bonding or press fit means. For example, thermal shield [16] may be of higher thermal conductivity metal such as copper, brass or monel for ease of attachment for example, which does not remove the full attractiveness of this thermal shield [16][16-1].

Figure 6:
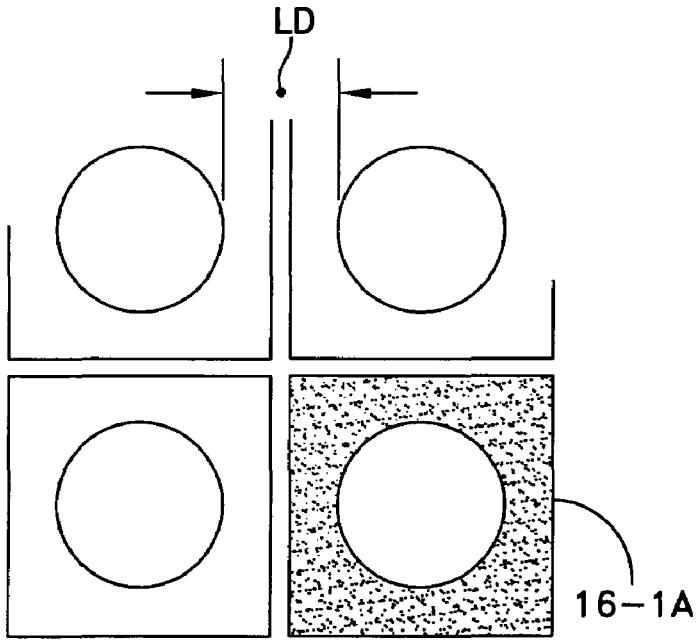
Figure 6:
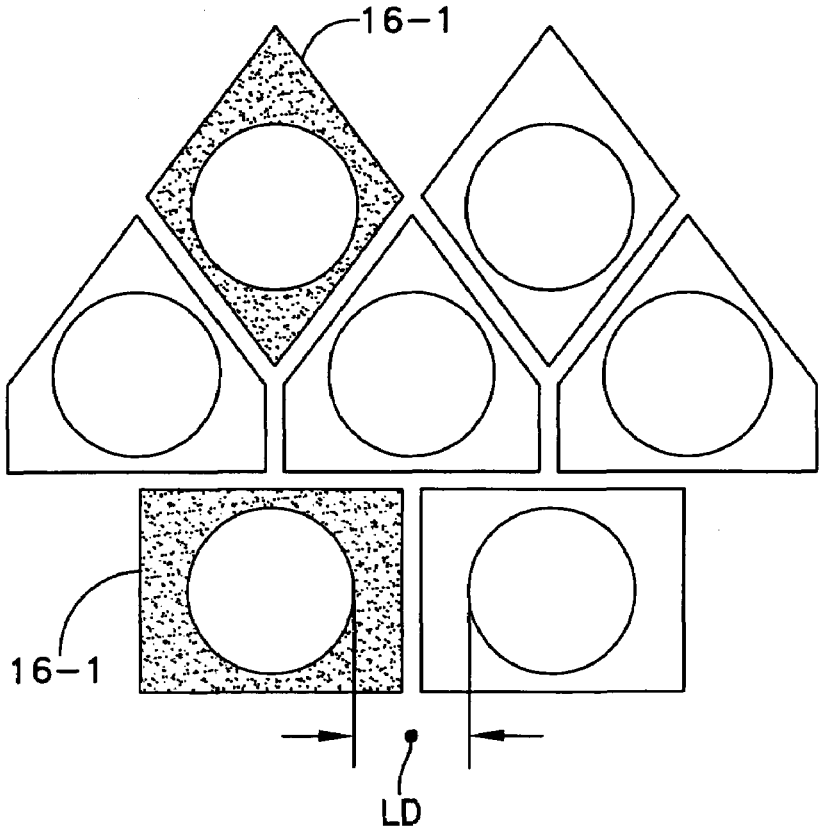

Now considering FIG. 6, there is shown a further detail of the aforementioned tube hole thermal shield lip extension [16-1] in FIG. 5. The lip extension of FIG. 6' is proportioned as a square [16-1A] such that the pattern of the lip extension shield interlocks and effectively covers the near entirety of the tube plate cold face. FIG. 6 shows a further interlocking shield lip extension [16-1], the final configuration of which is based upon tube hole pattern and the configuration basis is complete or nearly complete tube plate face coverage. Tube hole to tube hole metal distance is referred to here as tube hole ligament [LD].

DETAILED DESCRIPTION OF THE INVENTION

The invention relates to thermal stress in heat exchangers and more particularly to cryogenic heat exchangers and vaporizers of the U-bend type. Further to the bonnet closure and tube plate specifically used in cyclical operation which result in rapidly changing thermal gradients within the vital components within the tube plate, tube holes, tube to tube plate welded joint, splitter plate, channel or bonnet to tube plate closure details and in the inlet nozzle to the bonnet. It has been established that the present invention will extend the fatigue life while allowing a greater temperature difference between components within the tube plate and bonnet assembly and between the metal component and the heat exchange fluids than do prior art cryogenic and other heat exchangers. As a result, the present invention is found to be substantially resistant to thermal stress cracking and distortion, while at the same time retaining the full benefits of direct heat exchange between fluids of greater temperature difference which is common in prior art cryogenic heat exchangers of the U-bend and other types. The present invention also addresses the severe thermal stress at the tube entry point and the location where the tube exits the tube plate. The improvement reduces the thermal stress and resulting fatigue cracking within the tube plate, tube-to-tube plate welds and tube plate ligaments between tube holes.

This reduction of thermal stress gradients within the bonnet and tube plate (or tube sheet) allows for full consideration of the requirement of the applicable ASME code specifications without increase in component metal thickness or the use of intermediate temperature fluids which are used to reduce the temperature differences of cryogenic heat exchangers and vaporizers. By referring to the several drawings, the details of the prior art and the present invention are shown. More particularly FIGS. 4, 5 and 6 clearly illustrate the prior art cryogenic U-bend exchangers and the 12 thermal shield claims of the present invention.

Referring to FIG. 1, there is shown a metal component [3] of a heat exchanger without a thermal shield attached and the subsequent high thermal gradient [5] across the component. In operation, there is no control of the heat transmission rate resulting from fluid properties and velocities, as well as the fluid's temperatures $T_1$ at component surface [1] and $T_2$ at component surface [2]. In operation, the greater the temperature difference between $T_1$ and $T_2$, the greater the thermal stress within the component. Referring now to FIG. 2, there is shown the addition of a thermal shield [6] a preferred embodiment of the present invention to the metal component, which reduces the flow of heat through the metal component and thereby reducing the thermal stress within the component [3].

The thermal shield [6] is of a material which is compatible with the fluid temperatures $T_1$ and $T_2$ at surfaces [1] and [2]. In a preferred embodiment, the shield material [6] has a low thermal conductivity of a thickness such as ⅜ to ¾ inch thick, as compared to the normal 1 to 5 inch thickness of the metal component 3 and compatible with the desired thermal shield temperature gradient [8] between surface [1] corresponding to $T_1$ and intermediate surface [7] corresponding to $T_7$. In the more particular case of a cryogenic heat exchanger, the thermal shield material may be of non-metallic material such as Teflon or other PTFE compound of a particular thickness, which is bonded [9A] directly to the metal component or otherwise attached to the surface by mechanical means [9]. (Prior art ceramic coatings, high temperature shrouds and the like are noted and excluded from this description.)

FIG. 3 shows one embodiment of the invention wherein a U-bend heat exchanger is shown consisting essentially of a tube bundle [1] inserted into a heating fluid container [2] and affixed and sealed therein via a bolt and gasket detail at [12] and [13][13A].

In operation, cold fluid enters the bundle via inlet [17] flows through tubes [10] which are immersed within the heating fluid [14] and exits the bundle [1] at exit nozzle [18].

In the preferred embodiment, the tube plate [3] is protected from high thermal stress via tube hole thermal shield [15], tube plate thermal shield [6] and tube sleeve thermal shield [11].

Shield [15] reduces the higher flow of heat into the tube plate tube hole at [7-1] caused by the higher cold fluid velocity at the tube entry point. Shield [6] thermally separates the heating fluid temperature from the cold fluid temperature as depicted in FIG. 2 between $T_1$ and $T_2$ via the introduction of thermal gradient [8] shown in the aforesaid FIG. 2.

Since tube [7] is a metal component, which may conduct heat into the tube plate [3] through the holes in shield [6], shield sleeves [11] are added to each tube to extend the heat conductivity path into the tube plate caused by the tube as an alternate to an excessively thick thermal shield [6].

Further use of thermal shields is the addition of tube plate face shield [16] shown in FIG. 3. By preventing direct contact of the cold inlet fluid onto the face of the tube plate, added thermal gradient [8] in aforementioned FIG. 2 is introduced for thermal stress reduction in plate [3].

From viewing FIG. 4, it will be seen a typical state of the prior art cryogenic heat exchanger comprised of particular materials and components compatible with the established ASME code specifications applicable to the design requirements of the cryogenic and heating fluid temperatures involved. Strict adherence to the ASME code requirements requires that consideration of the thermal stress induced by the temperature differences between the cryogenic fluid well below −200° F. and the heating medium temperature well above +50° F., especially in the case of cyclical operation. Since austenitic stainless steel is a preferred material of construction in cryogenic pressurized fluid heat exchangers, consideration of the high susceptibility to thermal stress fatigue of austenitic stainless steel is required. Additionally by referring to the seal welding means of the tube end at the face of the tube plate [13] it can be appreciated that this is a point of high thermal stress and subsequent point of failure in prior art exchangers.

By now referring to FIG. 5 in conjunction with FIG. 4, it will be seen in FIG. 5 a preferred embodiment of a reduced thermal stress U-bend heat exchanger employing thermal shields [13], [15], [16] and [21]. Tube plate [8] is exposed to a thermal gradient from the heated side to the cold inlet side, which results in a thermal stress within the plate. By bonding or fastening the thermal shield [13] of low thermal conductivity material such as PTFE or Teflon to the tube plate hot surface side a significant portion of the temperature difference between the hot and cold surfaces is intercepted as it were thereby reducing the thermal stress. Typically, the fastening bolt [14] is used to secure the shield [13] to the plate [8]. Alternatively said shield [13] may be directly bonded using suitable cryogenic adhesive [14A] to plate [8].

It is apparent to those skilled in the art that the shield [13] need not be perfectly in contact with the plate [8] and that a small distance or gap such as 0.005 inches may remain between plate [8] and shield [13], since such gap forms an additional laminar boundary layer of air or heating medium fluid which further resists heat transmission and reduces the thermal stress within plate [8]. In certain cases, bonding adhesive [14A] excludes the heating medium from this space thereby preventing detrimental ice formation. In the preferred embodiment where the tube plate [8] is extended to form a flanged and gasketed assembly [9], it is appreciated that reduced thermal stress insures reduced tube plate distortion and potential leaking or failure of the gasketed assembly [3]. Unplanned leakage of the heating medium is considered today a fugitive emission to be avoided due to the most strict environmental considerations.

Now considering the thermal shield [15] formed by a tube sleeve of low conductivity material it is appreciated that the heat conducting path of the heated tube into the cooler tube plate [8] is significantly extended and such extension reduces the tube plate temperature gradient and resulting localized thermal stress at the tube hole and tube weld [13] in plate [8]. It is further recognized that tube hole thermal stress is detrimental to tube sealing at the tube hole and causes tube failure and tube-to-tube plate weld cracks, especially in cyclical operation.

The present invention is also directed at the high velocity entrance of the cold fluid into the tube [7] especially at the start-up time period. At start-up, the tube plate and tube portion within the tube plate are relatively hot due to prolonged exposure to the heating medium. The thermal impact of the initial flow of cold high velocity fluid entering the tube [7] causes a thermal shock, resulting in high thermal stress in excess of the normal steady state operating temperature gradient and resulting thermal stress. Tube hole internal thermal shield [16] reduces the tube hole and tube hole ligament [LD/FIG. 6] thermal shock at start-up and further it reduces the thermal gradient and resulting thermal stress in the tube plate [8] at the tube to tube hole joint. In the preferred embodiment, the tube hole internal thermal shield sleeve [16] extends outward and is provided with a flanged portion or lip, which shields the corner of the tube [7] entry region into plate [8]. Since this corner region is a primary sealing area between heating medium and cold fluid, high thermal stress at this juncture is the cause of leakage and weld cracks where the "tube-to-tube plate" sealing means is of the seal or strength welded type.

In a further embodiment the tube hole entry sleeve flange [16-1] is of such a flange dimension as to intersect with adjacent tube-hole sleeve flanges to form a complete thermal shield across the cold face of tube plate [8] as illustrated on FIG. 6. Now referring to FIG. 6' a preferred tube sleeve flange embodiment [16-1] referred to in FIG. 5+FIG. 6 is of a four sided parallelogram configuration for tubes pitched in triangular arrangement. Alternatively, for a square tube pitch within the tube plate [8], the preferred flange portion of the tube thermal internal sleeve becomes a square edge flange as shown in FIG. 6 as [16-1A]. In the preferred embodiment FIG. 6, essentially the entire cold face of tube plate [8], FIG. 4 is provided with an interlocking thermal shield via thermal shields [16-1] or [16-1A] configurations, which reduces the thermal gradient within the tube plate [8] by reducing or eliminating cold fluid impingement at and within the tube plate with resulting reduction of thermal stress. It is to be appreciated that further benefits accrue in this embodiment, when the heat exchanger is operated in a cyclical manner with repeated thermal cycles, which cause fatigue failure cracks within the tube plate [8].

Now referring to FIG. 5, the tube plate to channel manufacturing specific radius [17] is an embodiment of prior art to reduce the mechanical stress factor within the tube plate and channel at this intersection, even though this specific radius is not a strict requirement of the ASME codes (referred to above). As shown in prior art cryogenic heat exchanger FIG. 4, in some configurations it can be envisioned that the intersection joint of channel [10] to the tube plate [8] is formed by welding techniques resulting in a high residual stress connection. By now, referring to preferred embodiment FIG. 5, it is shown the addition of doubler plate [18] to the joint of channel [10] and tube plate [8]. Doubler plate [18], although not required by the ASME code of this prior art FIG. 4, in preferred embodiment of the present invention FIG. 5, it reduces the mechanical stress component at the intersection thereby providing greater resistance to failure during operations resulting in high thermal stress.

By now considering the partition or splitter plate [12] in the prior art configuration FIG. 4, it can be appreciated that high thermal stress will occur across this plate from cold side to hot exit side during either intermittent or continuous operation due to the temperature difference of the cold inlet fluid and heated exit fluid which are in intimate contact with the partition splitter plate [12]. In a preferred embodiment of the present invention shown on FIG. 5, the application of partition plate thermal shield [21] to the plate [12] effectively maintains the partition [12] at a relatively high temperature, correspondingly greatly reducing the temperature gradient within the partition plate, thereby achieving a significant reduction of thermal stress both within the plate and the intersection of this plate where it connects to bundle bonnet closure [6] and tube plate [8]. The thermal stress reduction is a beneficial effect of the thermal shield [21] of the present invention regardless of the method of attachment at the plate edges to other exchanger elements shown of FIG. 5 [17] of either forged, mechanical or welded techniques, as instructed by prior art. As with other embodiments of thermal shields of the present invention, the method of attachment of the shield to the plate is generally on the cold side of the partition by mechanical means or integral bonding means such as PTFE/Teflon shield material [21] covering partition, splitter plate [12]. It is also readily appreciated that reduced thermal stress in splitter plate [12] reduces potential distortion of the tube plate and the susceptibility to failure by leakage at gasket seal [3].

What is claimed is:

1. A heat exchanger for heating cryogenic fluids comprising an external shell defining a closed interior and having a tube plate having multiple tube openings disposed in said shell transversely to the longitudinal extent of said shell so as to divide said shell into an entry side including an entry chamber for cold fluids to enter said shell and a heating side where heating fluids warm said cryogenic fluids, a plurality of heat transfer tubes extending through said plate tube openings and into said heating side whereby cold fluid passes from said entry chamber into said tubes, said plate having a cold side adjacent said entry side wherein that plate cold surface is in contact with said cryogenic fluid and a hot side adjacent said heating side wherein that plate hot surface is in contact with heating fluid within the shell, and a layer of thermal insulating material selected from the class of PTFE, metal jacketed cork and micarta attached to at least one of said hot and cold surfaces of said plate so as to achieve a temperature differential of less than approximately 300° F. between said hot and cold surfaces of said plate so as to protect said plate from thermal stress.

2. The heat exchanger of claim 1, said shell entry side having a splitter plate dividing said entry side into and entry chamber and an exit chamber, said splitter plate disposed opposite said entry opening and having a low thermal conductivity thermal insulating material layer attached directly to the side thereof adjacent said entry chamber for protecting said splitter plate from thermal stress.

3. A heat exchanger of claim 1, wherein the channel is welded to the tube plate wherein the channel is supplied with a doubler plate for the purpose of protecting against stress failure at the welded junction.

4. A heat exchanger of claim 1, wherein the thermal insulating material is PTFE.

5. A heat exchanger of claim 1, wherein the tube internal thermal insulating sleeve has an extended flange forming an interlocking layer of thermal insulating material over the tube plate surface.

6. A heat exchanger of claim 1, wherein the tube plate is of austenitic stainless steel and the temperature gradient between the hot and cold surfaces thereof is no greater than approximately 300° F.

7. The heat exchanger of claim 1 wherein the heat exchanger is of the U-bend type and where a splitter plate is provided, said splitter plate having a thermal shield attached on one or both sides of the splitter plate.

8. A heat exchanger of claim 1 wherein said plurality of heat transfer tubes are provided with low thermal conductivity sleeves within each tube at the penetration of the tube plate on one side and/or an external tube sleeve on the other side of the plate for the purpose of reducing heat transfer into the tube plate from the tube surfaces having reducing thermal stress within the tube plate.

9. A cryogenic austenitic stainless steel tube bundle construction for use in a heat exchanger for heating cryogenic fluids comprising a tube plate having opposed hot and cold surfaces with a plurality of tubes extending through the plate and the plate cold surface provided with a layer of PTFE covering said plate surface wherein the temperature gradient within the tube plate across the surfaces thereof is reduced to no greater than approximately 300° F. for the purpose of reducing thermal stress within said tube plate thereby protecting said cryogenic tube bundle from cyclical thermal stress fatigue failure.

10. The tube bundle of claim 9 wherein said plurality of tubes are provided with sleeves within each tube at the penetration of said tube plate for the purpose of reducing thermal stress within said tube plate.

11. A method for reducing the thermal stress in a heat exchanger for heating cryogenic fluids which heat exchanger includes an austenitic stainless steel cryogenic tube plate, comprising the addition of a low conductivity insulating layer on at least one of said plate sides, such insulating layer being of a thickness effective to maintain the temperature difference across the sides of said plate to less than approximately 300° F. for the purpose of reducing thermal stress in said plate.

* * * * *